US005871619A

United States Patent [19]

Finley et al.

[11] Patent Number: 5,871,619

[45] **Date of Patent: *Feb. 16, 1999**

[54] PLUG SEAL DISCHARGE SYSTEM FOR DISTILLATION APPARATUS

[75] Inventors: Dana J. Finley; Jeffrey D. Wilder, both of Albuquerque, N. Mex.

[73] Assignee: Tire Recycling Technologies Corporation, Albuquerque, N. Mex.

[ * ] Notice: The term of this patent shall not extend beyond the expiration date of Pat. No. 5,714,043.

[21] Appl. No.: 527,865

[22] Filed: Sep. 14, 1995

[51] Int. Cl.[6] ..... C10B 35/00

[52] U.S. Cl. ..... 202/262; 198/545; 198/546; 198/550.1; 198/657; 202/251; 202/252; 202/253; 202/254; 202/260; 202/269; 406/53; 422/150; 422/232

[58] Field of Search ..... 198/545, 546, 198/550.1, 657; 202/251, 252, 253, 254, 260, 261, 262, 269; 406/453; 422/150, 232

[56] References Cited

U.S. PATENT DOCUMENTS

| | | | |
|---|---|---|---|
| 2,920,347 | 1/1960 | Joukainen et al. | 18/12 |
| 3,795,386 | 3/1974 | Carter et al. | 259/191 |
| 4,225,392 | 9/1980 | Taylor | 202/93 |
| 4,690,732 | 9/1987 | Everman et al. | 202/100 |
| 4,913,771 | 4/1990 | McIntyre | 202/269 |
| 5,423,950 | 6/1995 | Avetisian et al. | 202/261 |

*Primary Examiner*—Timothy McMahon

*Attorney, Agent, or Firm*—John R. Lansdowne

[57] ABSTRACT

A discharge system for a destructive distillation apparatus wherein the discharge solids act as plug to avoid the unwanted flow of product gas or ambient air therethrough while effectively discharging finely divided, disperse solids material from a continuously operating distillation apparatus. The use of a positive displacement two-stage auger having close clearance between the auger and auger cylinder wall, combined with an open section within the auger cylinder where a sealing material plug forms, results in improved sealing of the inventive system from unwanted transfer of gases. The hot, disperse, and finely divided solids exiting a distillation apparatus, such as carbon black formed from the distillation of automobile tire chips, is effective in the formation of a seal plug. The solid material sealing plug feature of the present invention is primarily intended as an additional sealing feature useful in conjunction with conventional drop or lock hoppers, but in some circumstances the use of these additional mechanical systems can be eliminated when using the sealing plug technology of the present invention. Also, the provision of inert gas systems as part of the discharge system may be eliminated by the employment of the inventive sealing plug system. The provision of a sealing plug section within the auger conveyor apparatus, along with the provision of small clearances between the outer edge of the auger flight and the auger cylindrical casing, allows the continuous operation of the distillation system without unwanted passage of ambient air into the system, or the passage of distillation product gases through the discharge system, and inhibits the passage of gas surges from the distillation apparatus through the auger conveyor to the solids disposition area.

23 Claims, 3 Drawing Sheets

PLUG SEAL DISCHARGE SYSTEM FOR DISTILLATION APPARATUS

BACKGROUND OF THE INVENTION

1. Field of the Invention

The present invention relates to destructive distillation apparatus. More particularly, the present invention relates to discharge systems for apparatus useful in the destructive distillation of waste automobile tires.

2. Discussion of the Prior Art

In the destructive distillation of carbonaceous materials, such as bulk chips of used automobile tires, the finely divided, disperse solids product or residue must be removed from the distillation apparatus. In the case of a batch still the removal of solids material is laborious and time consuming and results in significant downtime for the still. A continuously operating still is clearly desirable to carry out the destructive distillation process in an efficient manner with minimum labor. The lack of an effective system for the safe removal of hot solids material from a continuous destructive distillation apparatus has remained a substantial impediment to the use of continuous stills due to the difficulties involved in handling a continuous stream of finely divided, disperse solids product while preventing either the flow of distillation product gas or vapors out of the system with the carbonaceous solids, which can result in a fire, once the materials reach the outside atmosphere, or the flow of atmospheric air back into the still resulting in fires and explosions. Explosions result in equipment damage and process downtime.

Various systems have been employed in prior discharge systems to avoid potential explosions, including inert gas generators to blanket the discharge system with an inert gas such as combustion gas or nitrogen, and the use of lock hoppers or drop hoppers to isolate the discharge system from ambient air. The provision of inert gas generators in the system adds cost and complexity, and they are subject to failure, resulting in explosion hazards. Lock hoppers or drop hoppers, which provide an air lock between sequentially operated flap valves or rotating vane valves to provide for removal of disperse solids, are less than totally effective in excluding ambient air from the system and are ineffective in preventing the exit of product gases from the distillation process. Rotating vane valves are subject to excessive wear in the hot solids environment contemplated by the invention and fail to effect an adequate seal. Material buildup on flaps or gates results in unacceptable leakage of air and product gases.

The above-described drawbacks of prior art discharge systems have been overcome by the discharge system of the present invention wherein the discharge solids act as a plug seal to avoid the unwanted flow of product gas or ambient air therethrough while effectively discharging finely divided, disperse solids material from a continuously operating distillation apparatus. The use of positive displacement augers having close clearance between the auger and auger cylinder wall, combined with an open section within the auger cylinder where a material plug forms, results in improved sealing of the inventive system from unwanted transfer of gases.

The formation of a solids material plug for sealing in feeding systems is employed by Taylor (U.S. Pat. No. 4,225,392) for gasifier apparatus. However, it has not been previously recognized that the hot, disperse, and finely divided solids exiting a distillation apparatus, such as carbon black formed from the distillation of automobile tire chips, would be effective in the formation of a sealing plug.

Although the solid material sealing plug feature of the present invention is primarily intended as an additional sealing feature useful in conjunction with conventional drop or lock hoppers, it is envisioned that in some circumstances the use of these additional mechanical systems could be eliminated when using the sealing plug technology of the present invention. Also, the provision of inert gas systems as part of the discharge system may be eliminated by the employment of the inventive sealing plug system.

It also is generally known to use inclined auger conveyors in combination with valved lock hoppers in a solids discharge system for a retort or still, as shown, for example, by Everman et al. (U.S. Pat. No. 4,690,732. However, the improvements of the present invention, i.e., the provision of a sealing plug section within the auger conveyor apparatus, along with the provision of small clearances between the outer edge of the auger flight and the auger cylindrical casing, allows the continuous operation of the distillation system without unwanted passage of ambient air into the system, or the passage of distillation product gasses through the discharge system, and inhibiting the passage of gas surges from the distillation apparatus through the auger conveyor to the solids disposition area.

SUMMARY OF THE INVENTION

Accordingly, it is an object of the present invention to provide a system for discharging hot disperse solids such as carbon black from a continuously operating destructive distillation apparatus, such as one for the distillation of bulk chipped automobile tire material and the like.

It is another object of the present invention to provide a system for discharging solids from a continuously operating destructive distillation apparatus having the capability of transporting finely divided, disperse solids from the still while reducing explosion hazards by providing for effective sealing against the exit of still product gas and the entrance of ambient air to the still.

It is a further object of the present invention to provide a discharge system for a continuously operating destructive distillation apparatus having a spiral auger with a small clearance between the auger and its cylindrical casing for conveying disperse solids material while avoiding the flow of distillation gas surges or ambient air therethrough and thus avoiding explosion hazards.

It is yet another object of the present invention to provide a discharge system for a continuously operating destructive distillation apparatus having a spiral auger conveyor containing a sealing plug section where solids material is allowed to build up to form a plug to seal the discharge system from the flow of distillation product gas and ambient air therethrough, thus avoiding explosion hazards.

It is yet another object of the present invention to provide a discharge system for a destructive distillation apparatus having a two stage spiral auger conveyor with a plug forming section located between two flight sections wherein disperse solids material is allowed to build up to form a plug effective to seal the discharge system from the flow of distillation product gas and ambient air therethrough, thus avoiding explosion hazards.

Other objects, features, and advantages of the present invention will become apparent more fully from the following description.

BRIEF DESCRIPTION OF THE DRAWINGS

The accompanying drawings, which are incorporated in and form a part of the specification, illustrate an embodiment of the present invention and, together with the description, serve to explain the principles of the invention.

DETAILED DESCRIPTION OF THE INVENTION

Figure 1:
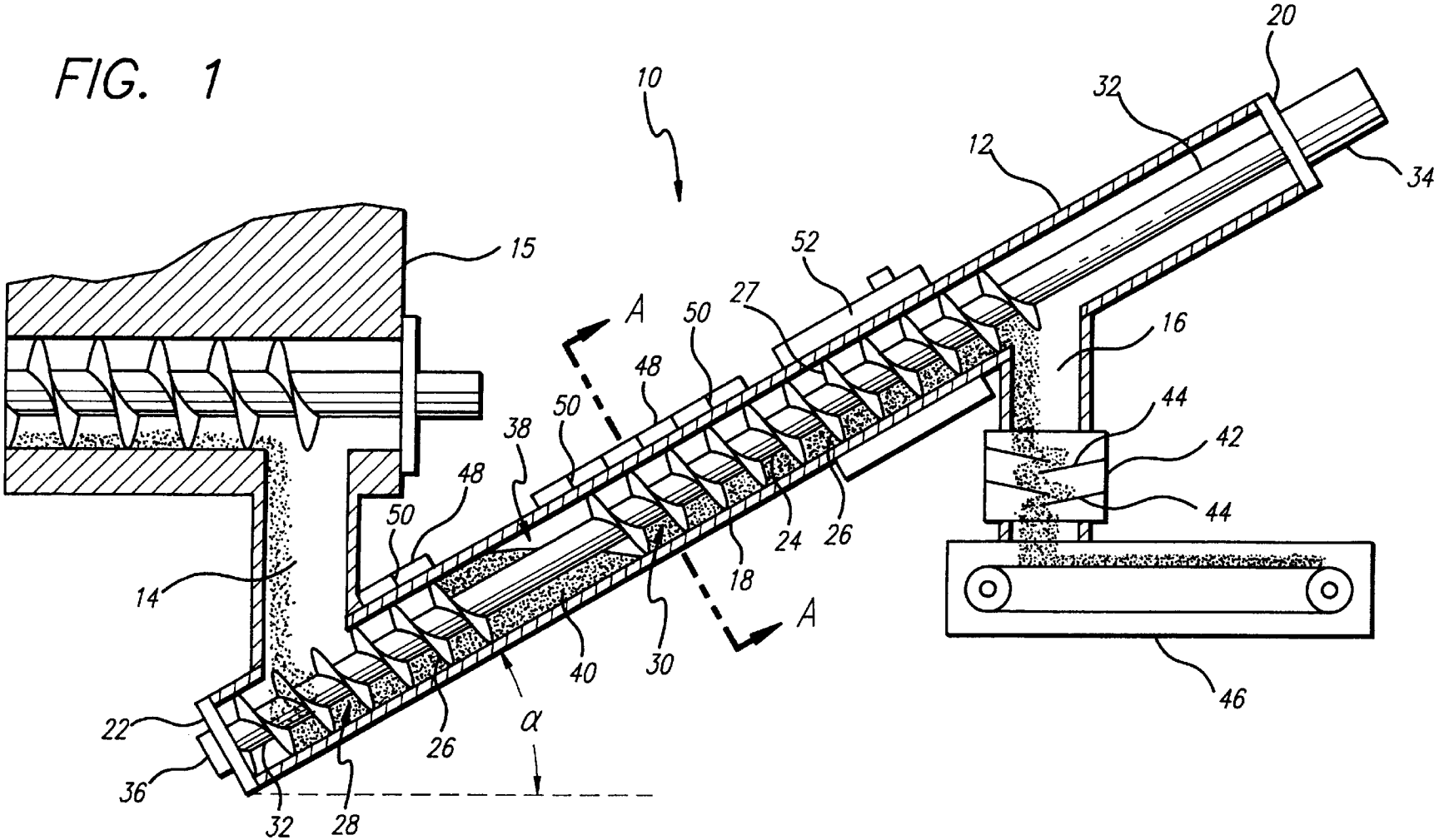
FIG. 1 is a diagrammatic sectional view in elevation of the outlet system of the present invention.
Figure 2:
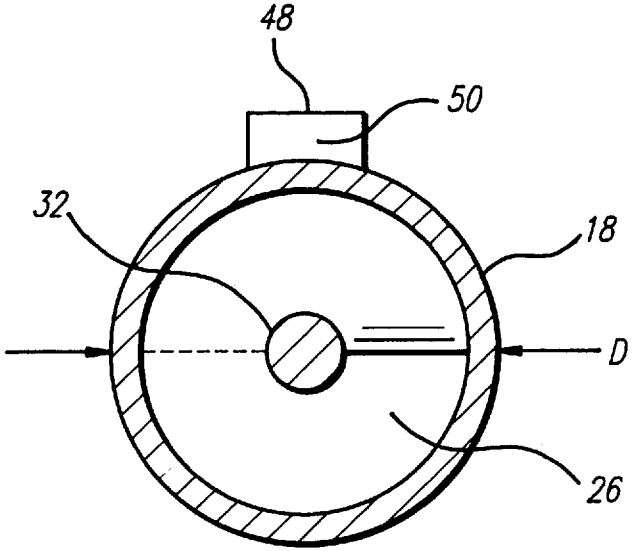
FIG. 2 is a cross sectional view along A—A of the auger and casing of the present invention illustrating the material collection channel.
Figure 3:
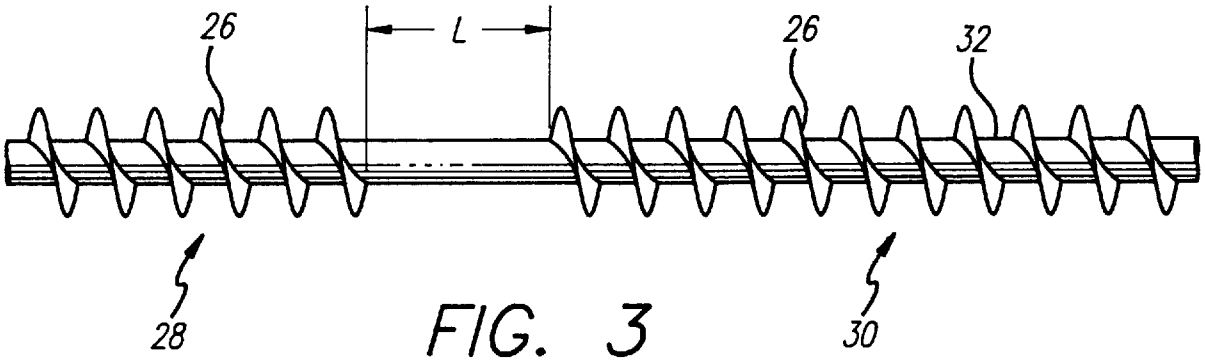
FIG. 3 is a detail view of the two-stage auger of the present invention.

Referring to FIGS. 1, 2, and 3, discharge system 10 comprises inclined two-stage auger tube 12 having at its lower end auger inlet 14, which is connected with decomposition chamber 15, and having at its upper end auger outlet 16. Inclined auger tube 12 includes cylindrical auger casing 18, having upper end cap 20 and lower end cap 22, and two-stage spiral or screw auger 24 having helical shaped spiral flights 26 and 27. Two-stage auger 24 (as best seen in FIG. 3) includes sequentially mounted first auger conveying stage 28 having spiral flight 26 and second auger conveying stage 30 having spiral flight 27 spaced from stage 28, each conveying stage having the same pitch and being mounted on auger shaft 32. Auger drive 34, which may be a motor or other power source, is mounted on upper end cap 20 and is connected to auger drive shaft 32. Auger drive 34 provides for rotation of two-stage auger 24 within cylindrical auger casing 18 along its longitudinal central axis. Auger drive shaft 32 is supported at its lower end by drive shaft bearing 36 mounted on lower end cap 22. Spiral auger flights 26 and 27 are of such diameter that a relatively close clearance is maintained with the inner wall of cylindrical auger casing 18, so as to avoid recirculation of any solid material and to inhibit passage of gases and air between the cylindrical auger casing 18 and the outer edge of spiral flights 26 and 27 of two-stage auger 24, the preferred clearance being about 3 millimeters. First stage 28 of auger 24 extends from inlet 14 and includes spiral flight 26 of sufficient length and appropriate pitch to assure that at least a full flighting (full turn) and preferably two flightings of flight 26 fully engage cylindrical auger casing 18 past inlet 14. Sealing plug section 38 is defined by first auger conveying stage 28 and second auger conveying stage 30 spaced therefrom and cylindrical auger casing 18. Sealing plug section 38 contains seal plug 40, comprised of compressed solids material exiting from first auger stage 28. Seal plug 40 is further compressed in sealing plug section 38 through friction with the interior surface of cylindrical auger casing 18. Seal plug 40 is of such size as to effectively seal sealing plug section 38 from passage of gases from inlet 14 therethrough and thus prevents passage of such gases along second stage auger 30 to outlet 16. Seal plug 40 also seals against entry of atmospheric air from outlet 16 through sealing plug section 38 to auger inlet 14, thus avoiding reactor explosions. Flight 27 of second auger conveying stage 30 picks up solids material from seal plug 40 as it moves upward within sealing plug section 38, due to additional material being supplied by first auger conveying stage 28.

Cylindrical auger casing 18 is supported by inlet 14 and outlet 16 at an angle e to the horizontal. The angle 0 may vary between about five and about sixty degrees and is preferably about thirty degrees. Double drop box or hopper 42 is connected to outlet 16 to avoid most intrusions of atmospheric air into discharge system 10. Solids material sequentially drops between drop box flaps or gates 44, which may be spring loaded or otherwise controlled in a known manner, to remain closed except when passing solids material. Conveyor 46, which may be of any conventional design, carries discharged solids material from drop box 42 to final disposition.

In a preferred embodiment, elongated material removal channels 48 (as best seen in FIGS. 1 and 2) are located extending along the upper side of cylindrical auger casing 18 in the vicinity of and coextensive with spiral flights 26 and 27, respectively, and communicating with the interior of cylindrical auger casing 18 along their length to provide for the accumulation of small bits of steel wire which may lodge between the outer edge of flights 26 and 27 and auger casing 18, causing difficulties in auger operation. This occurs, for example, when discharge system 10 is employed to handle decomposition products of bulk chipped steel belted rubber tire material. Baffles 50 are located at spaced locations along the length of channels 48 and are effective in preventing the flow of distillation product gases or air through channels 48. Water cooling jacket 52 is located on the exterior of and integral with cylindrical auger casing 18 near auger outlet 16 and is useful in cooling hot solids material before it exits the system and is exposed to ambient air.

In the operation of discharge system 10, finely divided solids material, such as carbon particles resulting from destructive distillation of automobile tire chips, is discharged from still decomposition chamber 15 and then enters two-stage inclined auger tube 12 through auger inlet 14. First auger conveying stage 28 of two-stage auger 24 engages the solids material by means of spiral flight 26 and, through the rotation action of the spiral flight 26, is compressed and transported upward within auger casing 18 toward sealing plug section 38. The compressed solids material is then continually added to seal plug 40, thus providing for sealing against distillation gas entering from auger inlet 14, which could result in fire or explosion further into the discharge system, or atmospheric air passage down through auger outlet 16 which could result in explosions in any reactor or distillation unit connected with auger inlet 14. Sealing plug section 38 is of a length and size such as to form a seal plug 40 extending over the entire cross section of cylindrical auger casing 18, thus forming a seal against passage of gases or air through the inclined auger tube 12. Spiral flight 27 of second auger conveying stage 30 engages solids material from the upper end of seal plug 40 and transports the material to auger outlet 16. Solids material then exits discharge system 10 through double drop box 42 and is conveyed by conveyor 46 for appropriate disposition.

In a preferred embodiment, material removal channels 48 extend along the upper side of cylindrical auger casing 18 in the vicinity of and coextensive with flight 26 of first auger conveying stage 24 and flight 27 of second auger conveying stage 26, respectively, and communicate with the interior thereof whereby small bits of steel wire or other debris trapped between the outer edge of spiral flights 26 and 27 and the interior wall of cylindrical auger casing 18 are collected. As the outer edge of a flight passes the point where the wire is trapped, the debris is free to drop into the mass of solids material and is incorporated therein. Baffles 50 are located at spaced locations along the length of channels 48 and are effective in preventing the flow of product gases or air through channels 48. Water cooling jacket 52 is useful in cooling hot solids material before it exits the system and is exposed to ambient air.

The lengths of the first and the second auger conveying stages may be of any desired length, but it is preferred that two flightings are employed past the auger inlet 14 in the first auger stage, and at least two flightings are employed past the sealing plug section 38 in the second auger stage, respectively. The lengths of the auger conveying stages should be, as a minimum, equal to the pitch length of the spiral flights so as to assure that a complete flighting is contained by the stage. Although the employment of a single flight for each conveying stage is illustrated in the above embodiment, multiple flights may be employed as desired in either stage. The overall length is determined by the height requirements of the installation.

The size and shape, and thus the sealing capability, of seal plug 40 is dependant upon the value of the angle θ. The angle θ may vary between about five and about sixty degrees and is preferably about thirty degrees. The preferred length of sealing plug section 38 is also dependant upon the desired plug configuration and thus upon the angle θ. The minimum length L (See FIGS. 2 and 3) of the plug section may be determined by the following formula:

$$L = \frac{1.5(D)}{\tan\theta} \quad (1)$$

Where L is the length of the sealing plug section, θ is the angle of inclination of the auger from the horizontal, and D is the diameter of the auger casing.

It is contemplated that an auger may contain more than two conveying stages and thus more than one sealing plug section and seal plug if desired. The diameter of the spiral auger 24 may be of any desired value, but a preferred diameter is about twenty four inches with a preferred flighting length or spacing of about twelve inches for a material handling capacity of about 40 tons of effluent material per 24 hour day operating at six RPM. For a given throughput, the diameter can be reduced by increasing rotational speed.

Figures 4, 5:
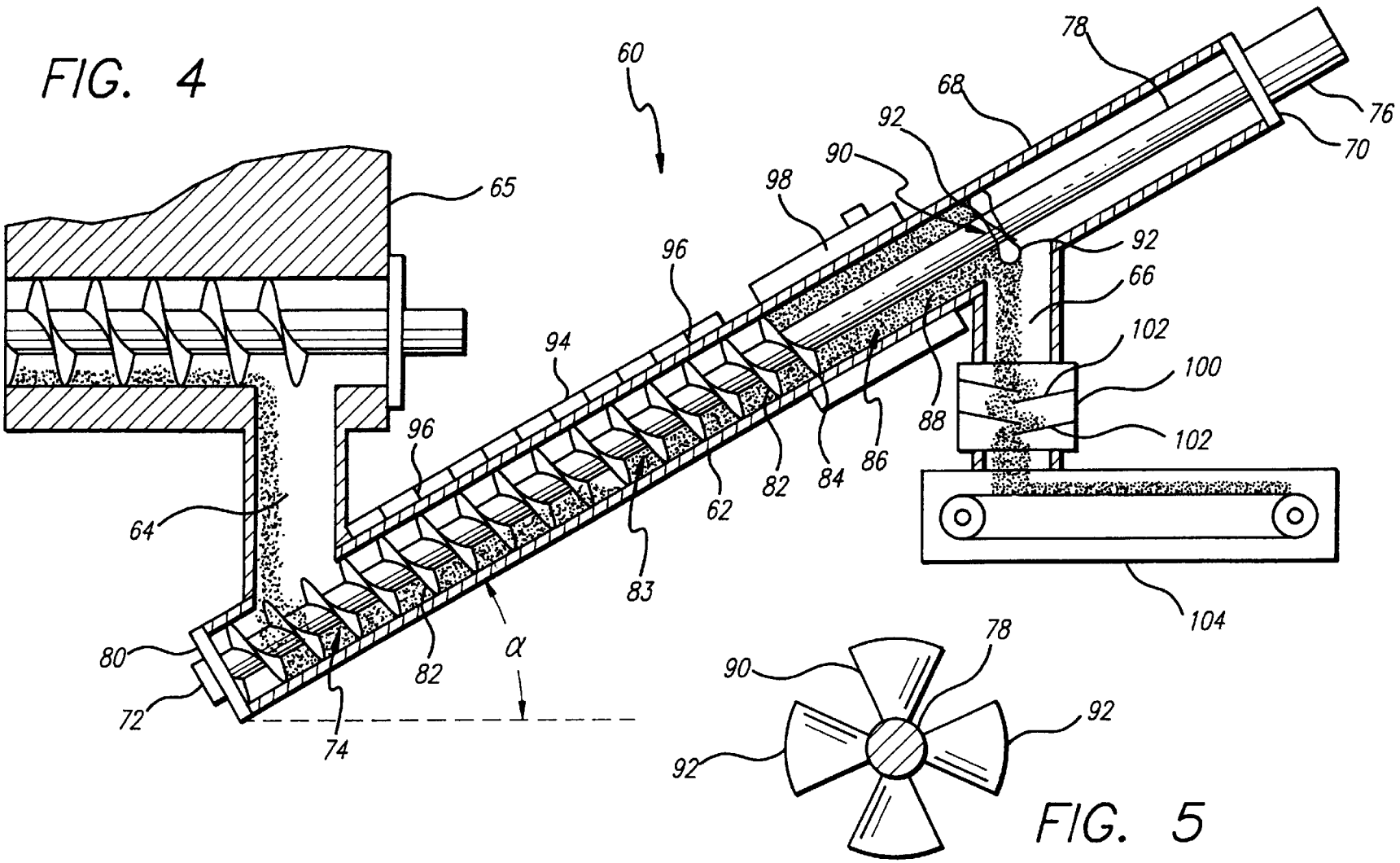
FIG. 4 is a diagrammatic sectional view in elevation of an alternative embodiment of the outlet system of the present invention.
FIG. 5 is a detail view of the plug breakup flighting of FIG. 4.

Referring to FIGS. 4 and 5, there is shown an alternative embodiment of the present invention wherein discharge system 60 includes inclined screw or spiral auger tube 62 having at its lower end auger inlet 64, which is connected with still decomposition chamber 65, at its upper end auger outlet 66. Spiral auger tube 62 includes cylindrical auger casing 68 having upper end cap 70 at its upper end and lower end cap 72 at its lower end. Rotatable auger 74 is located within cylindrical auger casing 68 along its central longitudinal axis. Rotatable auger 74 is driven by auger drive motor 76 mounted on the upper end cap 70 of spiral auger tube 62 so as to operate auger drive shaft 78 of rotatable auger 74 at a desired rotational speed. Auger drive shaft 78 is supported at its lower end by drive shaft bearing 80 mounted on lower end cap 72. A spiral flight 82 in the form of a helix is located on drive shaft 78 so as to form a single auger conveying stage 83. Inclined auger tube 62 is inclined at an angle α relative to horizontal depending on desired relative positions of the distillation unit and any conveying system for disposition of solids. Spiral flight 82 terminates at flight termination point 84 near the upper end of drive shaft 78 and below outlet 66 so as to define sealing plug section 86 within cylindrical casing 68. Sealing plug section 86 is free of spiral flight 82 and contains seal plug 88. Plug breakup flighting 90 is mounted on drive shaft 78 in the vicinity of outlet 66 and is so configured as to include truncated portions of a plurality of flights 92 angularly spaced around drive shaft 78 similar in configuration to blades in a rotating fan or impeller. Flights 92 rotate with drive shaft 78. Material removal channel 94 is located along the upper side of cylindrical casing 68 and communicates with the interior thereof. Material removal channel 94 is an elongated channel located in the vicinity of and substantially coextensive with auger conveying stage 83. Baffles 96 restrict the flow of gases or ambient air along channel 94. (See corresponding structure in FIGS. 1 & 2.) A water cooling jacket 98 is integral with and located along a portion of the exterior of cylindrical casing 68. Double drop box or hopper 100, having drop box flaps 102, is located at and communicates with outlet 66, communicating in turn with conveyor 104 of any conventional construction.

In operation, finely divided disperse solids material such as a mixture of carbon black and bits of steel wire from the distillation of bulk automobile tire chips is discharged from still decomposition chamber 65 and enters discharge system 60 through inlet 64 and is conveyed upward along inclined spiral auger tube 62 by the rotation of rotatable auger 74 and the action of spiral flight 82 of auger conveying stage 83 within cylindrical auger casing 68. As the material reaches flight end point 84 of conveying stage 83 it forms a seal plug 88 within sealing plug section 86. Seal plug 88 is developed through friction of solids material with the internal surface of cylindrical casing 68. Material in a compressed state in seal plug 88 moves toward outlet 66 where it is broken up into discrete pieces by plug breakup flighting 90, which pieces then fall into double drop box 100 and are subsequently removed by conveyor 104 to appropriate disposition. The clearance between cylindrical casing 68 and the outside edge of spiral flight 82 is maintained at a small value such as about 3 millimeters to restrict flow of distillation product gas surges entering through inlet 64, which could result in fire or explosion further into the discharge system, and to minimize the flow of ambient air entering through double lock box 100 from passing through auger tube 62 and resulting in an explosion hazard. Bits of steel wire or other material trapped between the interior surface of cylindrical casing 68 and flight 82 lodges in material removal channel 94 and, upon passing of the outer edge of a flight 82, then mixes with the bulk of material being conveyed in auger tube 62. Baffles 96 prevent flow of gases and ambient air through material removal channel 70. Seal plug 88 further seals against the flow of product gases or ambient air through sealing plug section 86 and through auger tube 62, thus avoiding an explosion hazard. Water cooling jacket 98 is useful in cooling hot solids material before it exits the system and is exposed to ambient air.

The length of the auger conveying stage 83 may be of any desired length, but it is preferred that at least two flightings are employed past the auger inlet 64. Although the employment of a single flight is illustrated in the above embodiment, multiple flights may be employed as desired in the auger conveying stage 83. The overall length is determined by the height requirements of the installation. The size and shape, and thus the sealing capability, of seal plug 88 is dependant upon the value of the angle α. The lower the angle value, the longer the plug 88 required to extend completely across the interior of sealing plug section 86. The angle a may vary between about five and about sixty degrees and is preferably about thirty degrees. The preferred length of sealing plug section 86 is at least the length of a flighting of spiral flight 82. The minimum length L of the plug section may be determined by the formula (1) above. The diameter of the rotatable auger 74 may be of any desired value, but a preferred diameter is about twenty four inches with a preferred flighting length or spacing of about twelve inches for a material handling capacity of about 40 tons of effluent material per 24 hour day operating at six RPM. For a given throughput, the diameter can be reduced by increasing rotational speed.

The equipment described in the above examples may be constructed according to standard engineering practice from materials standard in the field of destructive distillation systems.

The particular sizes and equipment discussed above are cited merely to illustrate particular embodiments of this invention. It is contemplated that the use of the invention may involve components having different sizes and shapes as long as the principles are followed, namely, the provision of an outlet system for a reactor or destructive distillation unit having a spiral auger having a sealing plug section so as to form a seal plug of solid material therein to avoid passage of gases and atmospheric air therethrough. It is intended that the scope of the invention be defined by the claims appended hereto.

We claim:

1. In a discharge system for a destructive distillation apparatus for processing carbonaceous material, such as waste automobile tire material or the like, having an inlet, an inclined solids conveying auger tube having a cylindrical casing, a rotatable spiral auger therein and means for rotating said spiral auger, the improvement comprising said inclined auger tube having a sealing plug section wherein conveyed solids material is allowed to accumulate to form a seal plug therein which acts to prevent flow of gases or ambient air therethrough, and wherein the clearance between said cylindrical casing and said rotatable spiral auger is of such small dimension as to substantially prevent the flow of gases or ambient air therebetween.

2. The discharge system of claim 1 wherein said auger tube is inclined at an angle from the horizontal within the range of from about five to about sixty degrees.

3. The discharge system of claim 2 wherein said angle is about 30 degrees.

4. The discharge system of claim 1 wherein said spiral auger is a two-stage spiral auger having a first auger conveying stage having a first flight and a second auger conveying stage having a second flight, said sealing plug section being located between said first stage and said second stage.

5. The discharge system of claim 4 wherein said first flight comprises at least two flightings and said second flight comprises at least two flightings.

6. The discharge system of claim 5 wherein the clearance between said spiral auger and said cylindrical casing is about 3 millimeters.

7. The discharge system of claim 5 wherein the length of said sealing plug section is at least equal to the length of one of said flightings.

8. The discharge system of claim 4 wherein said spiral auger has a plurality of auger conveying stages defining a plurality of sealing plug sections therebetween.

9. The discharge system of claim 1 further comprising comminuting means in an upper portion of said sealing plug section for comminuting said seal plug for further disposition of said solid material.

10. A solids discharge system for a destructive distillation apparatus for discharging finely divided solids material while excluding ambient air, comprising:

A. A discharge system inlet adapted to receive hot, finely divided solids material from a destructive distillation apparatus;

B. An inclined auger tube having an upper end and a lower end, said lower end being in communication with said inlet for conveying said solids material upward from said inlet; and C. A discharge system outlet in communication with said inclined auger tube at its said upper end;

D. Said inclined auger tube comprising an elongated auger rotatably mounted in a cylindrical auger casing along the central longitudinal axis thereof, and means for rotating said auger within said cylindrical auger casing;

E. Said elongated auger comprising an auger drive shaft and at least one spiral flight located along said auger drive shaft to form at least one auger conveying stage;

F. Said inclined auger tube being capable of conveying the finely divided solids material upward from said inlet to said outlet by means of rotation of said auger drive shaft and said spiral flight operating within said cylindrical auger casing;

G. Said auger tube having a sealing plug section therein located between said inlet and said outlet, said plug section being characterized by the absence of spiral flighting therein;

H. The clearance between said cylindrical casing and said rotatable spiral auger being of such small dimension so as to substantially prevent the flow of gases or ambient air therebetween;

whereby hot, finely divided solids material introduced to said auger inlet is conveyed upward along said inclined auger tube within said auger conveying stage and forms a seal plug within said sealing plug section effective to exclude ambient air, said solids material being continuously added to and removed from said seal plug, and whereby the flow of gases from said distillation apparatus and the introduction of ambient air to said distillation apparatus are substantially prevented.

11. The discharge system of claim 10 wherein said inclined auger tube is inclined at an angle from the horizontal within the range of from about 5 to about sixty degrees.

12. The discharge system of claim 11 wherein said spiral auger has a first auger conveying stage having a first spiral flight and a second auger conveying stage having a second spiral flight, said sealing plug section being located between and its length defined by said first stage and said second stage.

13. The discharge system of claim 12 wherein said first spiral flight comprises at least one flighting and said second spiral flight comprises at least one flighting.

14. The discharge system of claim 13 wherein the clearance between said rotatably mounted auger and said cylindrical casing is about three millimeters.

15. The discharge system of claim 14 wherein the length of said sealing plug section is at least equal to the length of one of said flights.

16. The discharge system of claim 12 wherein said spiral auger has a plurality of auger conveying stages defining a plurality of individual seal plug sections therebetween.

17. The discharge system of claim 12 further comprising at least one elongated material collection channel located along the upper side of said cylindrical auger casing and communicating with the interior thereof, said channel being located in the vicinity of and coextensive with at least one of said first auger conveying stage and said second auger conveying stage.

18. The discharge system of claim 17 further comprising a plurality of baffles at spaced locations within and extending across said material collection channel effective to prevent flow of ambient air and distillation gases along said channel.

19. The discharge system of claim 12 further comprising a water cooling jacket integral with the exterior wall of said cylindrical auger casing and located in the vicinity of the upper end thereof for cooling said finely divided solids material prior to its discharge through said auger outlet.

20. The discharge system of claim 10 further comprising comminuting means located in said seal plug section at the upper end thereof for comminuting said seal plug for further disposition.

21. The discharge system of claim 20 wherein said comminuting means comprises a plurality of truncated spiral flights located on said auger drive shaft.

22. The discharge system of claim 10 further comprising a double drop box connected with and in communication with said auger outlet for discharging said finely divided solids material while further inhibiting entry of air to said discharge system.

23. The discharge system of claim 22 further comprising an outlet conveyor communicating with said double drop box for conveying discharged solids material from said double drop hopper to final disposition.

* * * * *